US010344593B2

(12) United States Patent
Pastorino et al.

(10) Patent No.: US 10,344,593 B2
(45) Date of Patent: Jul. 9, 2019

(54) GROUT DELIVERY SYSTEM

(71) Applicant: NCM INNOVATIONS (PTY) LTD., Johannesburg (ZA)

(72) Inventors: Paolo Ettore Pastorino, Johannesburg (ZA); Adrian Berghorst, Johannesburg (ZA)

(73) Assignee: NCM INNOVATIONS (PTY) LTD., Johannesburg (ZA)

( * ) Notice: Subject to any disclaimer, the term of this patent is extended or adjusted under 35 U.S.C. 154(b) by 0 days.

(21) Appl. No.: 15/578,001

(22) PCT Filed: Jun. 23, 2016

(86) PCT No.: PCT/ZA2016/000017
§ 371 (c)(1),
(2) Date: Nov. 29, 2017

(87) PCT Pub. No.: WO2016/210456
PCT Pub. Date: Dec. 29, 2016

(65) Prior Publication Data

US 2018/0291737 A1 Oct. 11, 2018

(30) Foreign Application Priority Data

Jun. 23, 2015 (ZA) ..... 2015/04498

(51) Int. Cl.
*E21D 20/02* (2006.01)
*E21D 21/00* (2006.01)

(52) U.S. Cl.
CPC ..... *E21D 21/0026* (2013.01); *E21D 20/02* (2013.01); *E21D 20/028* (2013.01);
(Continued)

(58) Field of Classification Search
CPC .... E21D 20/02; E21D 20/028; E21D 21/0033
See application file for complete search history.

(56) References Cited

U.S. PATENT DOCUMENTS 4,158,519 A * 6/1979 Gamlin ..... E21D 20/02
405/259.5
4,334,805 A * 6/1982 Morgan ..... E21D 21/0026
405/259.4

(Continued)

FOREIGN PATENT DOCUMENTS

CA 2490111 A1 * 12/2003 ..... E21D 20/02
CA 2494781 A1 * 2/2004 ..... E21D 20/02

(Continued)

*Primary Examiner* — Frederick L Lagman
(74) *Attorney, Agent, or Firm* — Young & Thompson

(57) ABSTRACT

A rock bolt assembly includes a rock bolt with an elongate body between distal and proximal ends, a tubular sleeve with first and second ends, proximal and distal ends of the bolt projecting from first and second ends of the sleeve, a load bearing barrel centrally bored to engage the rock bolt between the sleeve's first end and the bolt's proximal end, which barrel is adapted at a forward end to engage with the sleeve's second end in sealing contact, and which barrel has at least one grout conduit between the barrel's exterior surface and the bore, which at least one conduit defines a part of a grout passage which communicates the exterior surface of the barrel with an interior of the sleeve, when the barrel is engaged with the sleeve, and a seal which seals the grout passage to grout outflow but accommodates inflow of grout from a source.

12 Claims, 10 Drawing Sheets

(52) U.S. Cl.
CPC ..... *E21D 21/0006* (2013.01); *E21D 21/008* (2013.01); *E21D 21/0033* (2013.01)

(56) References Cited

U.S. PATENT DOCUMENTS

| | | | | | |
|---|---|---|---|---|---|
| 4,697,960 | A * | 10/1987 | Pelto | E21D 20/023 | 366/10 |
| 5,636,945 | A * | 6/1997 | Nes | E21D 21/0086 | 405/259.1 |
| 7,381,013 | B1 * | 6/2008 | Rataj | E21D 21/0033 | 405/259.3 |
| 8,714,883 | B2 * | 5/2014 | Rataj | E21D 21/0033 | 405/259.3 |
| 9,470,088 | B2 * | 10/2016 | Ahola | E21D 20/028 | |
| 2011/0168398 | A1 * | 7/2011 | Gray | E21B 21/10 | 166/325 |
| 2012/0163924 | A1 * | 6/2012 | Rataj | E21D 21/0033 | 405/259.3 |
| 2012/0177448 | A1 * | 7/2012 | Steyn | E21D 20/028 | 405/259.5 |
| 2014/0037388 | A1 * | 2/2014 | Ahola | E21D 20/02 | 405/259.3 |

FOREIGN PATENT DOCUMENTS

| | | | | |
|---|---|---|---|---|
| CA | 2763338 | A1 * | 7/2012 | F16B 13/066 |
| CA | 2893814 | A1 * | 6/2014 | E21D 20/028 |
| WO | WO-2004013463 | A1 * | 2/2004 | E21D 20/02 |
| WO | WO 2012113976 | * | 8/2012 | E21D 20/02 |
| WO | WO 2014091074 | * | 6/2014 | |

* cited by examiner

GROUT DELIVERY SYSTEM

FIELD OF THE INVENTION

The invention relates to an apparatus for grouting a rock bolt in a rock hole.

BACKGROUND OF INVENTION

Grouting of a rock anchor within a rock hole is a difficult and messy affair.

Typically, a grout conduit connected to a grout source needs to be attached to a grout pipe that projects from the rock hole. The problem is that the rock anchor installation is often at a height that is not easily reached. Moreover, there is a need for a connector to connect a nozzle end of the grout conduit to the grout pipe to ensure a sealed connection to prevent grout outflow from the connection interface.

Also, in such an installation, the mouth of the rock hole needs to be sealed from grout egress once the rock hole is filled with grout. Therefore, in a typical grouted rock anchor installation, there are many points at which the grout can leak.

The invention at least partially solves the aforementioned problems.

SUMMARY OF INVENTION

A rock bolt assembly which includes a rock bolt with an elongate body which extends between a distal end and a proximal end, a tubular sleeve which sleeve longitudinally extends between a first end and a second end, on the rock bolt such that proximal and distal ends of the bolt project from the first and second ends respectively of the sleeve, a load bearing barrel which is centrally bored to engage the rock bolt between the first end of the sleeve and the proximal end of the bolt, which barrel is adapted at a forward end to engage with the second end of the sleeve in sealing contact, and which barrel has at least one grout conduit between an exterior surface of the barrel and the bore, which at least one conduit defines a part of a grout passage which communicates the exterior surface of the barrel with an interior of the sleeve, when the barrel is engaged with the sleeve, and a seal which seals the grout passage to grout outflow but accommodates inflow of grout from a source.

The sleeve may have a flared end section which opens onto the first end.

The load bearing barrel may be comprised of a solid body of a suitable metal material which has a domed or conical forward end and an opposed back end.

The barrel may have a plurality of grout conduits. The plurality of grout passages may be evenly radially spaced about the body.

The assembly may include a tensioning means. Preferably, the tensioning means is a nut threaded on the bolt between the proximal end of the bolt and the back end of the barrel.

The assembly may include a tubular spacer on the rock bolt between the first end of the sleeve and the forward end of the barrel or between the back end of the barrel and the tensioning means.

The tubular spacer may be made of a suitable plastics material which deforms or breaks when a compressive force is applied to it to collapse or break away from the rock bolt, allowing the rock bolt to move longitudinally relatively to the sleeve between a first position and a second position.

The assembly may include a mechanical anchor engaged with the rock bolt on or towards the distal end.

The mechanical anchor may be at least partially received within the sleeve in an unexpended configuration when the rock bolt is in the first position.

The mechanical anchor may move from the sleeve into an expanded configuration when the rock bolt is in the second position.

The assembly may include a grout delivery coupling member which includes a body with a member first end and a member second end and a passage between the ends, a circular distributing channel in a wall of the passage and a grout inlet port in a side of the member which communicates an exterior of the member with the channel, wherein the passage is adapted to at least partially receive the barrel from the member first end and to engage with the barrel in a position in which the at least one grout conduit of the barrel sealingly docks with the channel.

The coupling member may engage with the barrel in a twist-lock manner.

The barrel, alternatively the coupling member, may have a plurality of bayonet type projections which engage with complementary slots or recesses on the coupling member, alternatively the barrel.

A grouting kit for grouting a rock bolt in a rock hole which includes a load bearing barrel which is centrally bored to engage with the rock bolt and which has at least one grout conduit between an exterior surface of the barrel and the bore and a seal which seals the grout conduit, and a grout delivery coupling member which includes a body with a first end and a second end and a passage between the ends, a circular distributing channel in a wall of the cylindrical passage and a grout inlet port in a side of the member which communicates an exterior of the member with the channel, wherein the passage is adapted to receive the barrel from the first end and to engage with the barrel in a position in which the at least one grout conduit sealingly docks with the channel.

The sleeve may have a flared end section which opens onto the first end.

The load bearing barrel may be comprised of a solid body of a suitable metal material which has a domed or conical forward end and an opposed back end.

The barrel may have a plurality of grout conduits. The plurality of grout passages may be evenly radially spaced about the body.

The coupling member may engage with the barrel in a twist-lock manner.

The barrel, alternatively the coupling member, may have a plurality of bayonet type projections which engage with complementary slots or recesses on the coupling member, alternatively the barrel.

The invention provides a method of anchoring a rock bolt within a rock hole, the rock bolt including an outer sleeve which extends between a first end and a second end opening into a funnel, an elongate bolt body which extends between a distal end and a proximal end, which locates within the sleeve and distal end section and a proximal end section extending beyond the first end and the second end of the sleeve as a distal end section and proximal end respectively, the distal end section of the bolt body partly carrying a mechanical anchor which is at least partly held within the sleeve in a closed position and the proximal end section of the bolt body being, at least partly, threaded, a faceplate located over the sleeve, a barrel on the threads of the proximal end section and a fastener on the threads between the barrel and the proximal end, the method including the steps of pre-spacing the barrel from the funnel or the fastener from the barrel, inserting the rock bolt into a predrilled rock hole, distal end leading, until the faceplate is sandwiched between a rock wall and an outer surface of the funnel and pushing the bolt body further into the rock hole to close the pre-spacing allowing the rock bolt to move relatively to the sleeve to drive the mechanical anchor from the first end of the sleeve and into an radially expansive open position in which the mechanical anchor resistively engages the walls of the rock hole.

The rock bolt may include a tubular sleeve which locates on the bolt body, between the funnel and barrel to space the barrel from the funnel.

The tubular sleeve may be made of a suitable plastics material which deforms or breaks when a force pushing the bolt further into the hole reaches a predetermined level.

To introduce a grout into the rock hole, the method may include the additional steps of engaging a coupling device to the barrel and pumping a grout material from a source through the coupling device and at least one channel provided in a side of the barrel, into an annular space between the sleeve and the bolt body and, eventually, into an annular space between the sleeve and walls of the rock hole.

BRIEF DESCRIPTION OF THE DRAWINGS

The invention is described with reference to the following drawings in which.

DESCRIPTION OF PREFERRED EMBODIMENTS

Figure 1B:
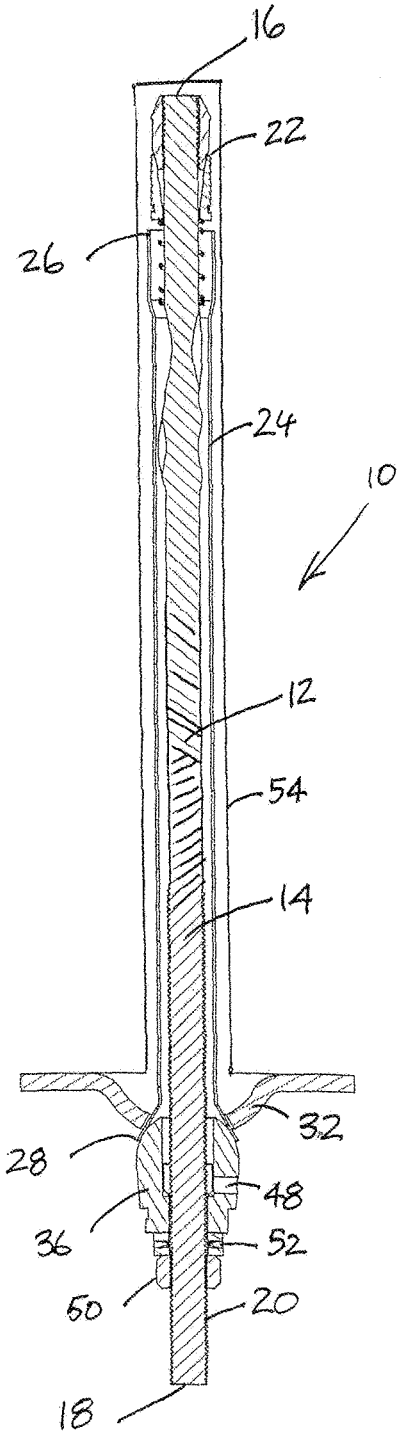
FIGS. 1A and 1B illustrate longitudinal sections through a rock bolt assembly in accordance with a first embodiment of the invention.

Referring to FIGS. 1 to 4 of the accompanying drawings, a rock bolt assembly 10 is provided in accordance with a first embodiment of the invention.

The assembly includes a rock bolt 12, of a standard type, having an elongate rod-like body 14 which extends between a first or leading end 16 and a second or trailing end 18. The body has a threaded end section 20 which leads from the second end 18 and, located on the bolt body, towards the first end, is a mechanical anchor 22 (see FIGS. 1A and 1B) of a standard expansion shell type.

The assembly 10 includes an elongate sleeve 24 which can have, on an outer surface, a plurality of corrugations (shown on FIG. 7) and which extends between a first end 26 and a second end 28. Towards the second end, the sleeve flares into a flared end section 30 which opens on the second end 28.

Figure 1A:
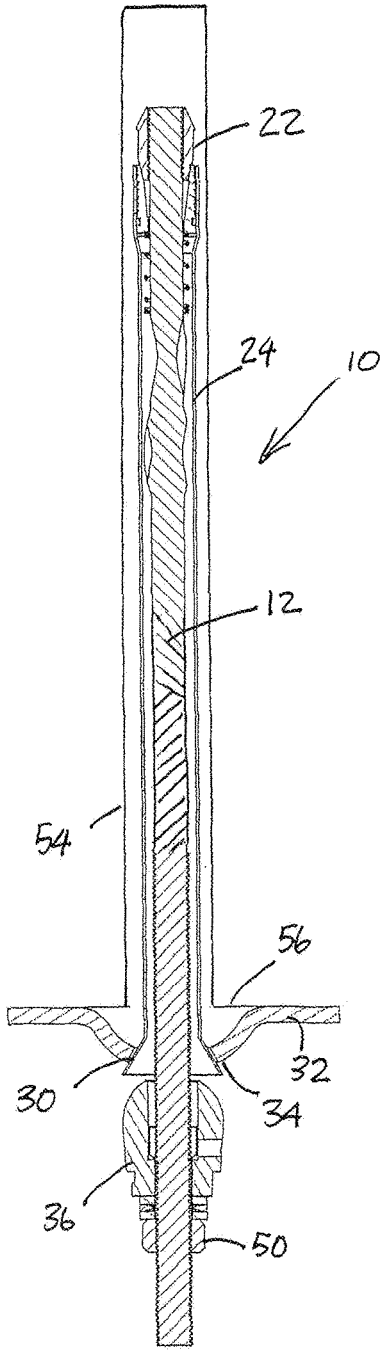
Figures 2A, 2B:
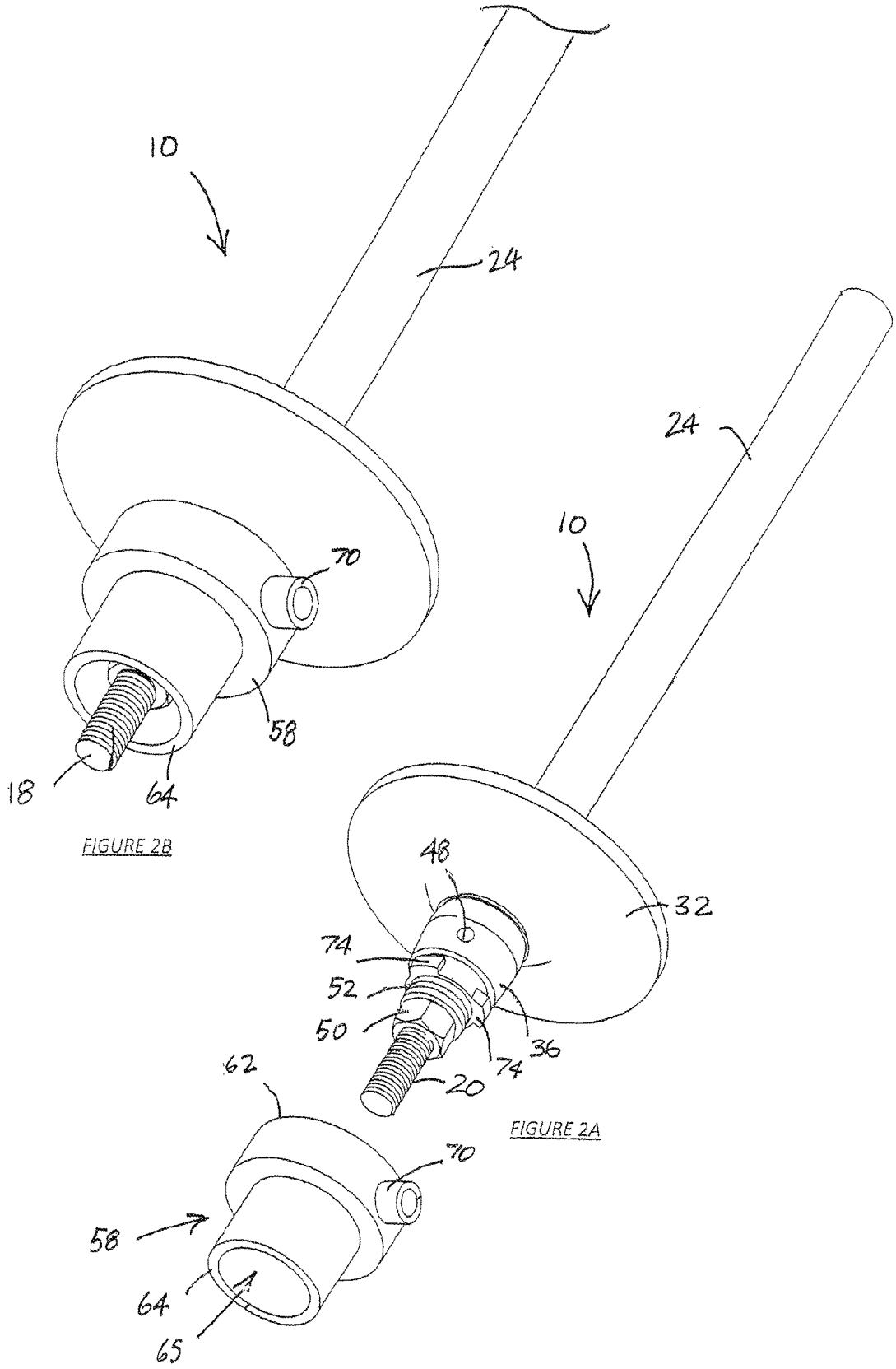
FIGS. 2A and 2B isometrically illustrate the assembly of FIGS. 1A and 1B.
Figure 3:
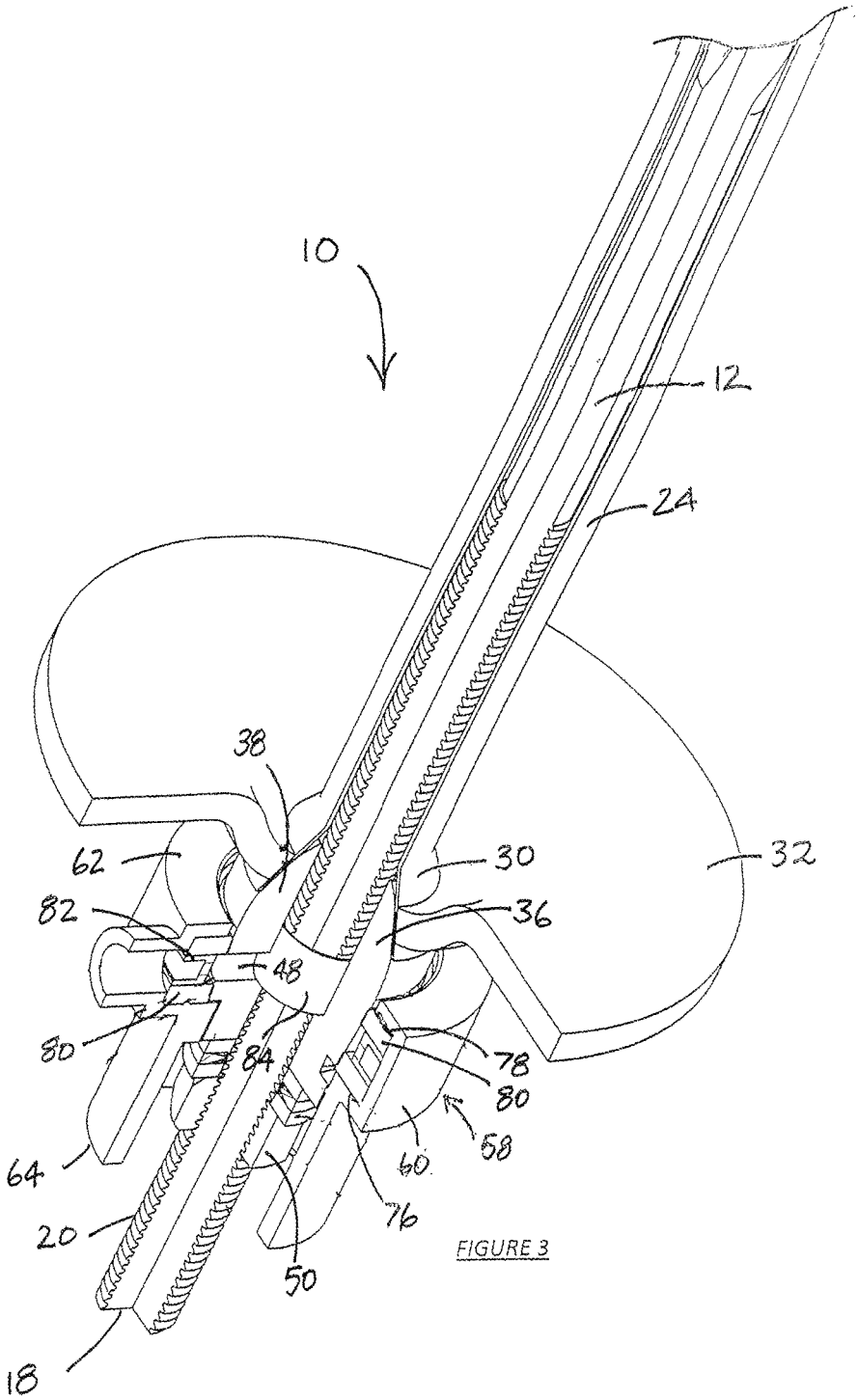
FIG. 3 isometrically illustrates, in partial section, the rock bolt assembly of the preceding Figures.
Figure 4:
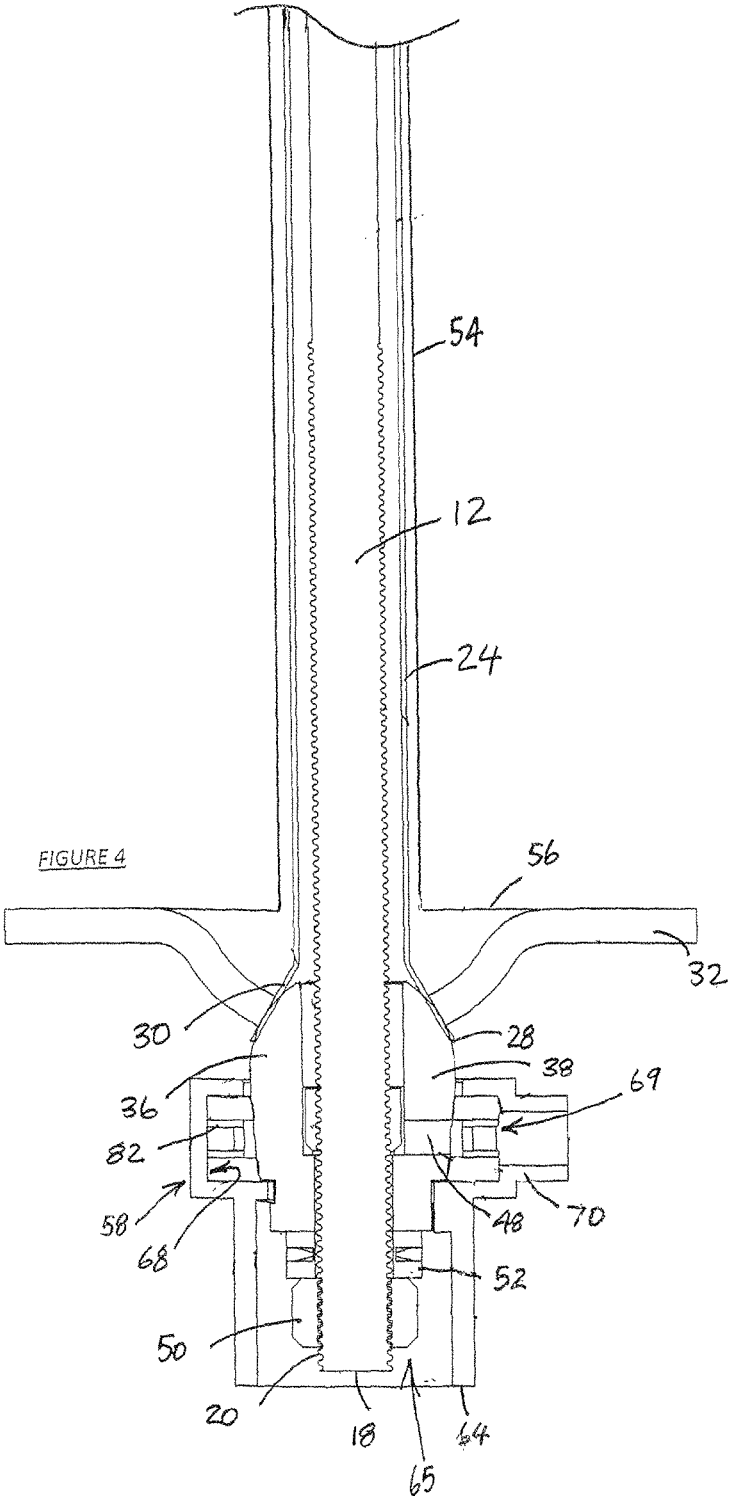
FIG. 4 illustrates in longitudinal section, the rock bolt assembly.

The sleeve is adapted to receive the rock bolt 12 with the first end and second ends (16, 18) of the bolt extending beyond the first end and second ends (26, 28) respectively of the sleeve and is held in position by frictional engagement with the anchor 22 which is at least partially received in this sleeve at the first end 26 as illustrated in FIG. 1A.

Resting on an outer surface of the flared end section, a faceplate 32 is included with the assembly. The sleeve 24 is engaged with the faceplate by passage through a central aperture 34 of the plate.

Figure 5A:
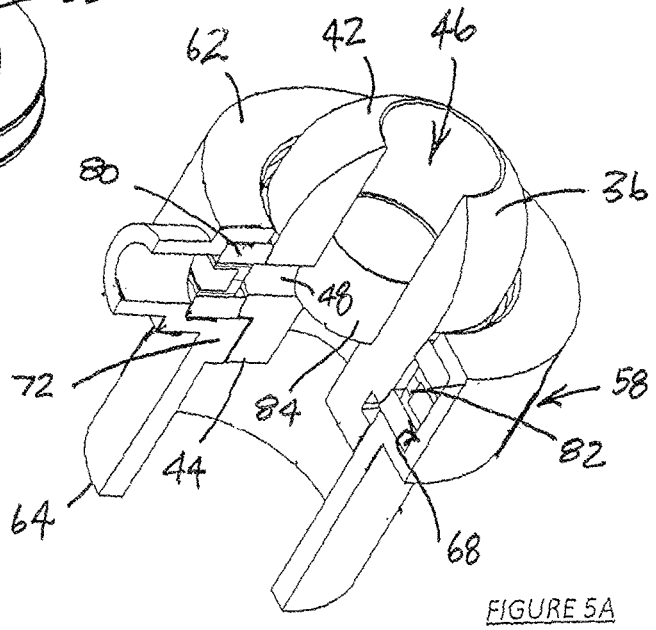
FIGS. 5A and 5B isometrically illustrate, in partial section, a barrel and a coupling member assembly in accordance with the first embodiment of the invention and as part of the rock bolt assembly of the preceding Figures.
Figure 5B:
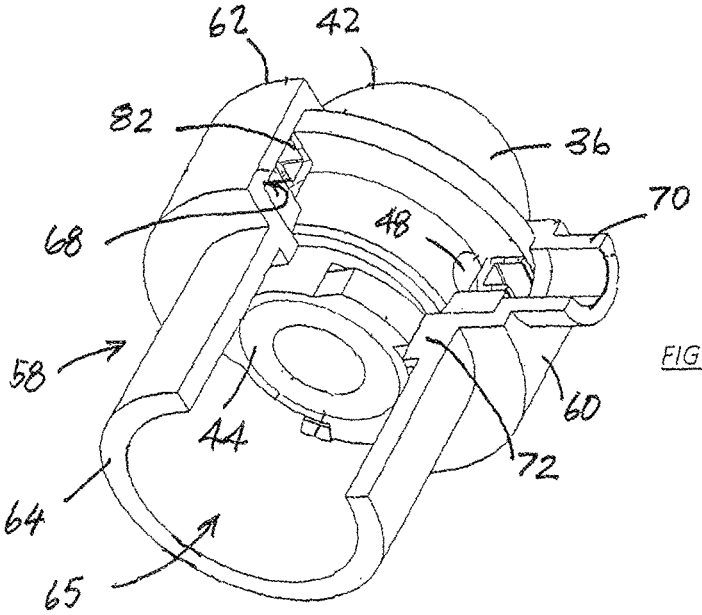

As best illustrated in FIGS. 5A and 5B, the assembly 10 further includes a barrel 36 comprised of a solid barrel-shaped metal body 38. The body 38 has a domed end 42 and a trailing end 44 with a central bore 46 extending between the ends. In a sidewall of the barrel, a plurality of grout conduits 48 are formed (only one is illustrated in the Figures), uniformly radially spaced, communicating an exterior of the barrel with the bore 46.

The rock bolt 12 is passed through the barrel's central bore 46, from the bolt second end 18, to locate on the threaded section 20. To hold the barrel 36 in position on the threaded section, initially spaced from the flared end section 30 of the sleeve 24, a nut 50 is threaded onto the threaded section 20 behind the barrel to eventually contact the trailing end 44 of the barrel's body. A load indicating washer 52 can be interposed between the nut 50 and the trailing end 44 to indicate when load on the barrel has reached a predetermined level.

Prior to grouting, the rock bolt assembly 10, with the rock bolt 12 received in the sleeve 24 and the faceplate 32 and barrel 30 pre-attached as described, is inserted into a predrilled rock hole 54 with the first end 16 of the bolt body leading. In this pre-configuration, the first end 26 of the sleeve at least partially covers the mechanical anchor 22, as illustrated in FIG. 1A, to retain the anchor in a closed unexpanded position.

When the faceplate 32 comes into contact with the hanging wall 56 the sleeve is prevented from further passage into the rock hole by contact of the flared end section 30 with the faceplate. However the rock bolt 12 is capable of further movement, axially inwardly relatively to the sleeve, as illustrated in FIG. 1B. This further movement pushes the mechanical anchor 22 from the confines of the sleeve at the first end 26 allowing the anchor to radially expand under spring action into frictional engagement with the surrounding walls of the rock hole 54. The mechanical anchor will thus secure the rock bolt within the rock hole about the halt first end 16.

Upward movement of the rock bolt also will cause the domed end 40 of the barrel 36 to come into sealing contact with an inside of the flared end section 30. This is as illustrated in FIG. 1B. The nut 50 can now be tightened against the barrel to bring about load bearing contact of the barrel with the flared end section of the sleeve. The assembly 10 is now ready to be grouted.

To enable grouting of assembly 10, a coupling member 58 is provided. The coupling member 58 includes a body 60 which extends between a first end 62 and an opposed second end 64. The body defines a cylindrical passage 65 which extends between the ends.

In an inner wall of the cylindrical passage 65, a circular distributing channel 68 (designated on FIG. 4) is formed. The channel is disposed towards the first end 62. A hole 89 penetrates the side of the coupling member which extends into a corresponding side projecting inlet port 70. The inlet port is adapted to attach to a grout delivery from a hose (not shown). The port thus communicates with the bore 46 via the hole, the channel and the conduit 48.

Below the channel 68, towards the second end 64, the cylindrical passage is formed with a locking formation 72 which receives complementary bayonet formations 74 (see FIG. 2B) in twist lock engagement as more fully described below. The bayonet formation laterally extends from an outer surface of the barrel 36 towards the trailing end 44 of said barrel.

Figure 6:
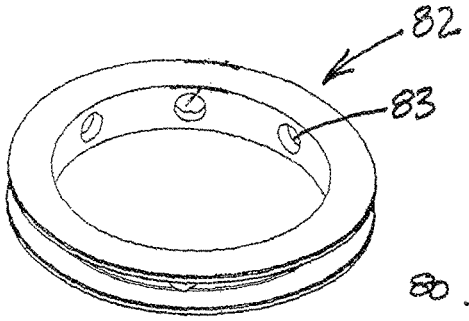
FIG. 6 is an isometric illustration of a circular spacing ring which is included in the coupling member illustrated in FIGS. 5A and 5B.

On a floor and a roof surface (respectively designated 76 and 78 on FIG. 3) of the channel 68, a respective circular sealing formation 80 is provided, held apart by a spacing ring 82 (see FIG. 6). Apertures 83 of the ring allow the passage of grout as will be explained more fully below.

The coupling member 58 is to be attached to the barrel 36 so that grout, from a source (not shown), can be delivered through the barrel and into the sleeve. Firstly, the grout delivery hose is pre-attached to the inlet port. Secondly, an elevating shaft (not shown) is connected, at one end, to the second end 64 of the coupling member by, for example, receiving the second end within a complimentary shaped recess in the end of the lance. Thereafter, the coupling member 58 is elevated on the shaft and presented to a barrel engaged end of the pre-installed rock bolt assembly 10, the first end 62 of the member leading.

The barrel 36 is then partially received into the cylindrical passage 65 from the first end 62 and engaged with the coupling member 58 within the passage. Engagement is achieved by twisting the coupling member relatively to the barrel to receive the bayonet formation 74 of the barrel within the locking formation 72.

Locked within the passage, the barrel is positioned such that each of the grout conduits 48 is in planar alignment with the circular distribution channel 68. The opposed sealing formations 80 in the channel seal the docking engagement of the grout conduits with the distributing channel.

Grout can now be pumped through the grout delivery hose for delivery to the inlet port 70, through the side hole 69 and into the grout distributing channel 68. In the channel, grout is circumferentially distributed about the barrel for entry into the central bore 46 through each of the plurality of grout conduits 48. Grout egress from points of contact of the barrel with the coupling member 58 is prevented by the sealing formations 80 which sandwich the channel.

Flowing from the grout conduits 48, the grout passes a band seal 84 which is caused to move away from an exit of each grout conduits to allow the grout to flow into an interior of the sleeve 24 via the bore 46. Within the sleeve, about the rock bolt 12, the grout percolates upwardly until reaching the first end 24 of the sleeve, at which point the grout cascades downwardly into the annular space between the sleeve and the rock-hole walls.

Grout is prevented from flowing back into the grout conduits 48 by the band seal 84 which is forced back against the exits of the grout conduits.

Thus, with the grouting of the rock bolt assembly 10, the rock bolt 12 is grouted within the sleeve 24 which, in turn, is grouted within the rock hole.

Figure 7B:
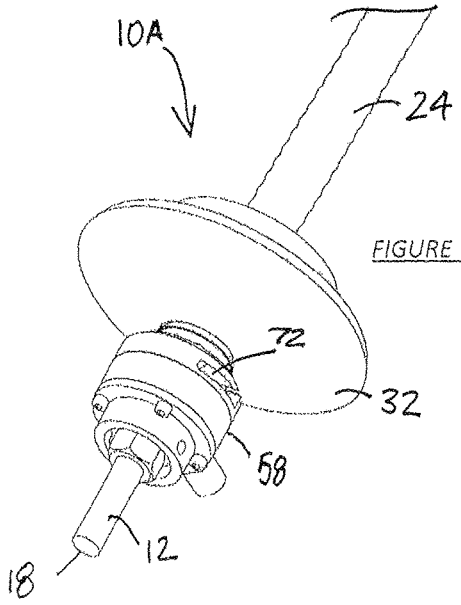
FIGS. 7A and 7B partially isometrically illustrates a rock bolt assembly in accordance with a second embodiment of the invention.
Figure 7A:
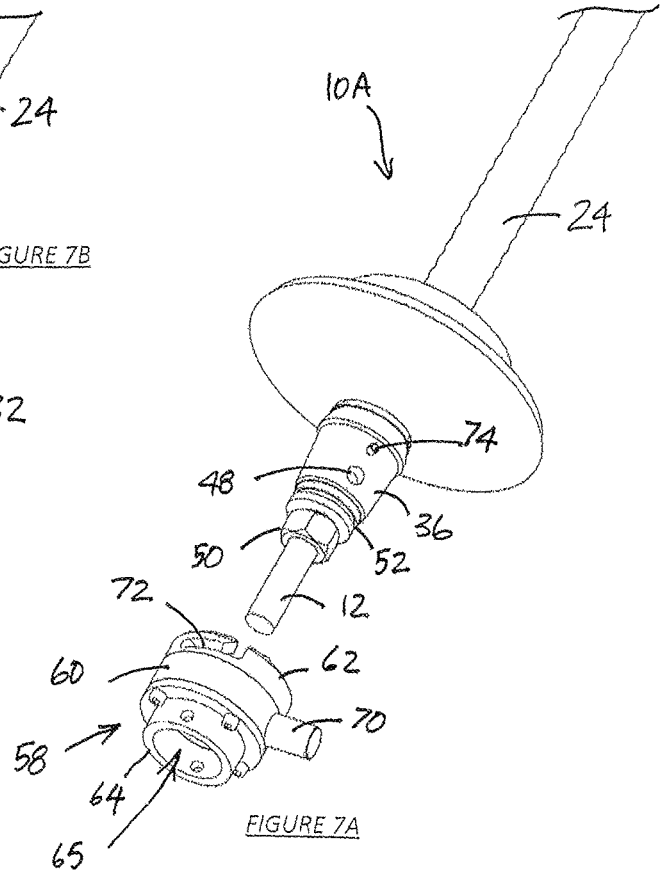
Figure 8A:
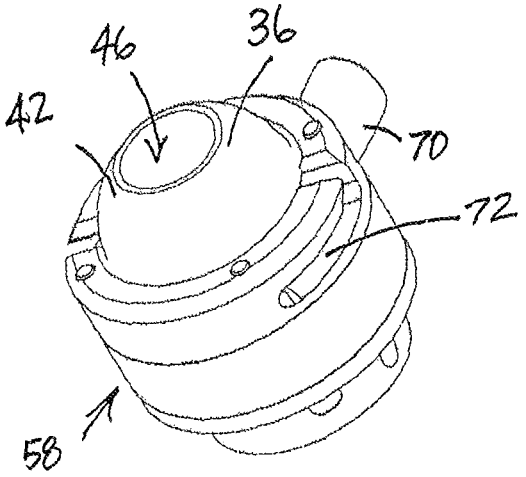
FIGS. 8A and 8B isometrically illustrates, in partial section a barrel and a coupling member as part of the rock bolt assembly of FIG. 7.
Figure 8B:
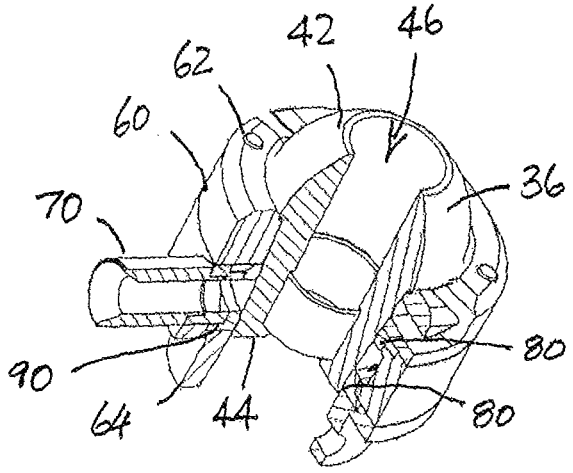

FIGS. 7 and 8 illustrate a second embodiment of the invention. In describing this embodiment, like features bear like designations and the description will be confined to how this embodiment differs from the first embodiment.

Essentially, the rock bolt assembly 10A differs from the rock bolt assembly 10 in the way in which the coupling member 58 is engaged with the barrel 36.

The barrel 36 includes a pair of bayonets 74 (see FIG. 7A) that laterally extend from an outer surface of the barrel on diametrically opposed sides towards the domed end 42.

These bayonets 74 engage with complementary slots 72, formed in a wall at the first end 62 of the coupling member body.

Another difference is that the coupling member 58 of the embodiment does not include a spacing ring 82. Instead, the sealing formations 80 are spaced within the distributing channel 68 by being partially held within undercut formations 90 (see FIG. 8B) in a wall of the channel.

Figure 9C:
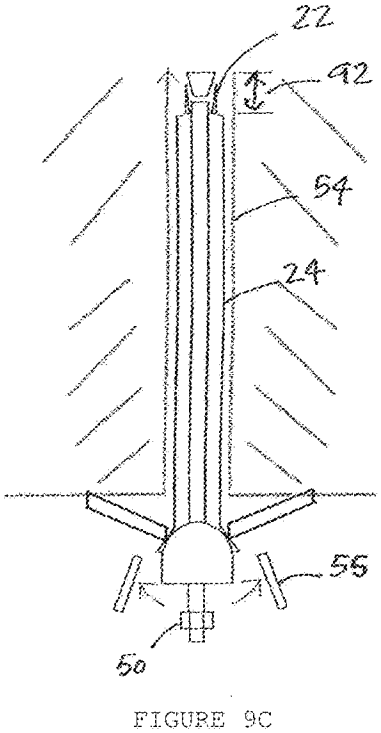
FIGS. 9A to 9C serially and diagrammatically illustrate the rock bolt assembly of either embodiment with a tubular spacer being inserted into a rock hole in a method of the invention.
Figure 9B:
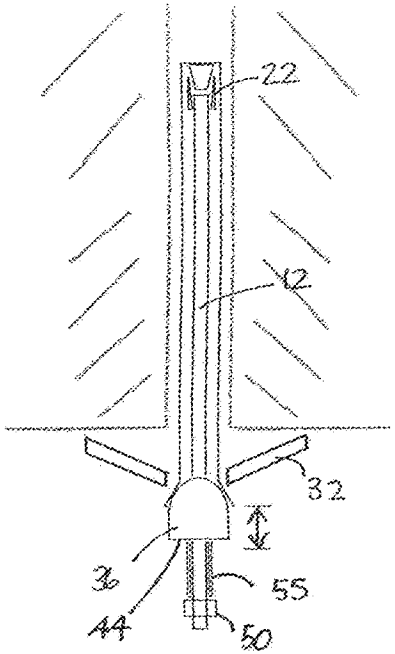
Figure 9A:
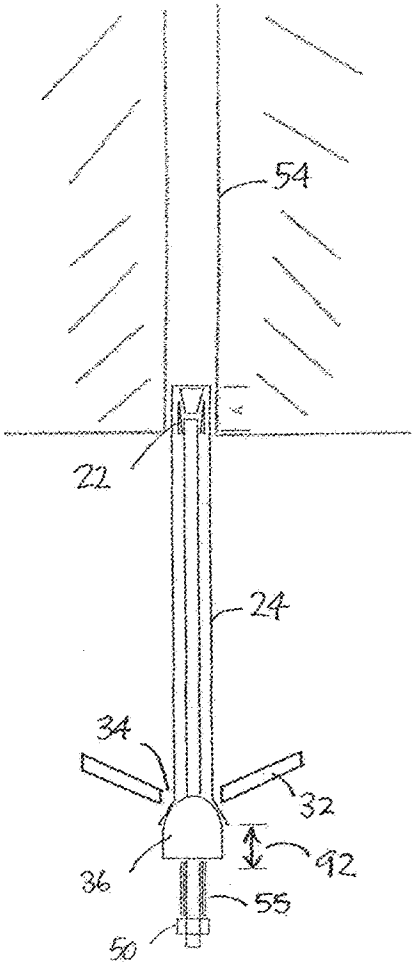

FIG. 9 illustrates a variant on the embodiments of the invention wherein the rock bolt assembly (10 and 10A) is provided with a tubular spacer 55 made of a suitable plastics material. The spacer 55 provides a suitable offset space (designated 92 on FIGS. 9A and 9C) equivalent to the distance of longitudinal travel (also designated 92 on FIG. 6C) that is required of the rock bolt 12 relatively to the sleeve 24, once in the rock bolt is in the rock hole, to move the mechanical anchor 22 from the confines of the sleeve so that it can radially expand into frictional engagement with the rock hole walls.

Once installed, a further inwardly directed force on the rock bolt 14 by, for example, the installation machine (not shown) will be taken up by the sleeve 55 which will eventually collapse or break away at a pre-defined load point. This is illustrated in FIG. 9C.

With relative longitudinal movement of the rock bolt 14 relatively to the sleeve 24 no longer prevented by the collapsed or moved spacer 55, the bolt moves inwardly relatively to the sleeve and, in so doing, the nested mechanical anchor 22 is pushed from the confines of the sleeve. Unconfined, the mechanical anchor radially expands under spring biasing action.

The tubular spacer 55 is pre-installed to provide a complete unit of the assembly (10 and 10A) and is sandwiched between the trailing end 44 of the barrel 36 and the nut 50.

Figure 10:
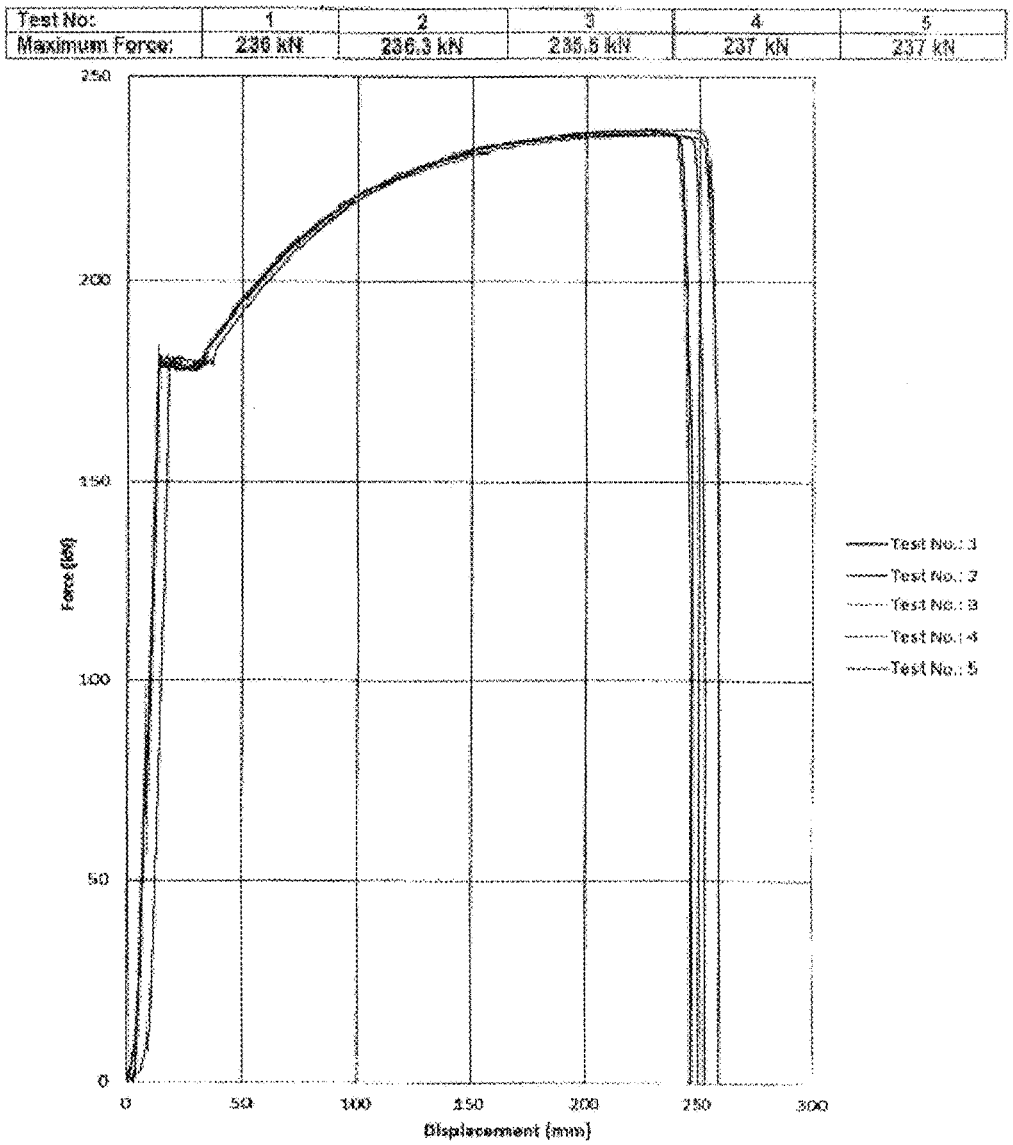
FIGS. 10 and 11 are graphs respectively illustrating a comparison of the static load carrying capacity of a typical bolt verses a bolt in accordance with the invention.

The static load carrying capacity of a typical bolt, without a sleeve, is at most about 21 tons. The load deformation curve that is plotted from a pull test used to determine load follows a specific curve profile that is anticipated in steel tensile testing. See FIG. 10.

What the applicant surprisingly discovered when doing further tests on the rock bolt assembly 10 of the invention was that the static carrying capacity had increased by about 30% and that the profile of the stress-strain graph also changed to a rather square profile that is unlike the standard yield graph for standard steel.

Figure 11:
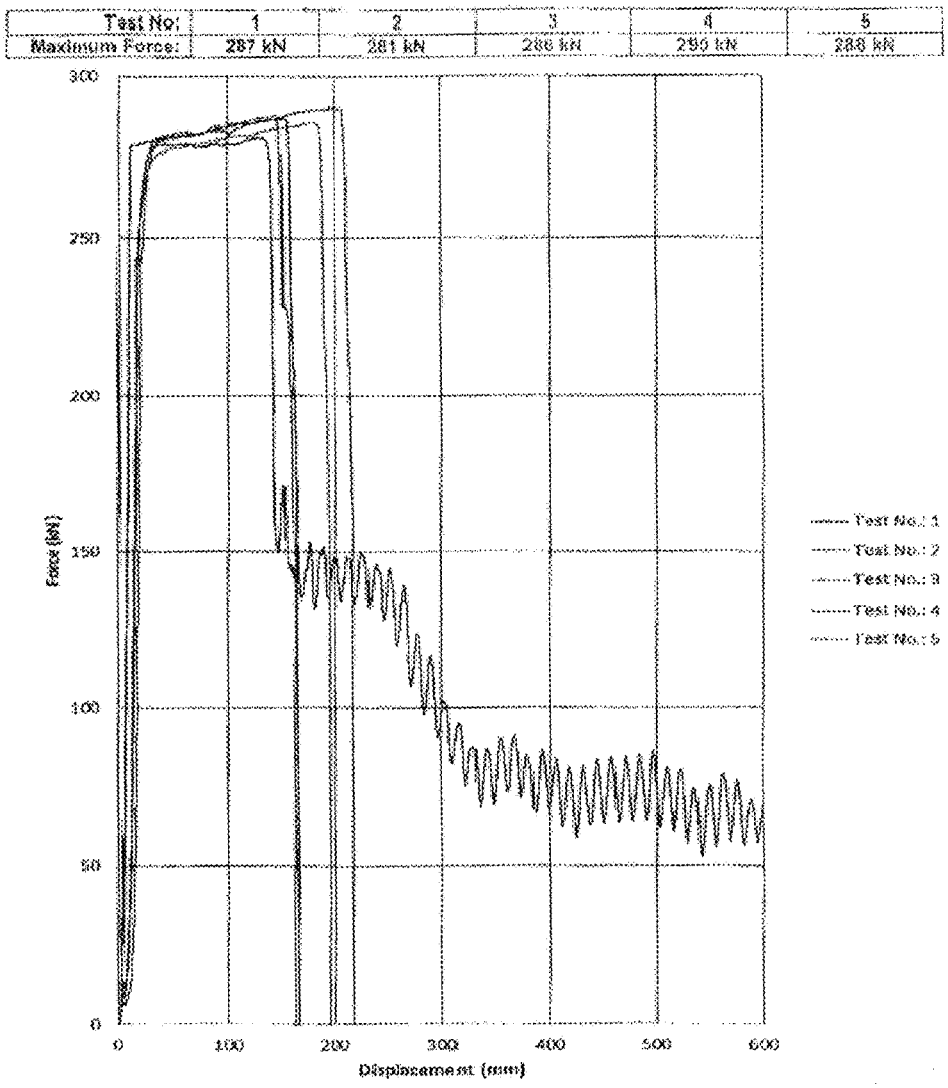

What this essentially means is that with use of the rock bolt assembly 10 in accordance with either embodiment, there is an increase in the overall energy absorption when compared to a standard rock bolt. An explanation could be that the rock bolt broke but the sleeve did not fail at the same point and, possibly, the sleeve slowly pulled from the grout thus explaining the jagged profile section in FIG. 11. The jagged profile section extends the displacement capacity of the assembly 10 of the invention well beyond conventional rock bolts.

The invention claimed is:

1. A rock bolt assembly which includes a rock bolt with an elongate body which extends between a distal end and a proximal end, a tubular sleeve longitudinally extending between a first end and a second end, on the rock bolt such that proximal and distal ends of the bolt project from the first and second ends respectively of the sleeve, a load bearing barrel which has a central bore to engage the rock bolt between the first end of the sleeve and the proximal end of the bolt, which barrel is adapted at a forward end to engage with the first end of the sleeve in sealing contact, and which barrel has at least one grout conduit between an exterior surface of the barrel and the central bore, which at least one conduit defines a part of a grout passage which communicates the exterior surface of the barrel with an interior of the sleeve when the barrel is engaged with the sleeve, a seal which seals the grout passage to grout outflow but accommodates inflow of grout from a source, a tubular spacer on the rock bolt between the first end of the sleeve and the forward end of the barrel or between the back end of the barrel and a tensioning means, wherein the tubular spacer is made of a suitable plastics material which deforms or breaks when a compressive force is applied to it to collapse or break away from the rock bolt, allowing the rock bolt to move longitudinally relatively to the sleeve between a first position and a second position, and a mechanical anchor engaged with the rock bolt on or towards the distal end, wherein the mechanical anchor is at least partially received within the sleeve in an unexpanded configuration when the rock bolt is in the first position and, wherein the mechanical anchor moves from the sleeve into an expanded configuration when the rock bolt is in the second position.

2. A rock bolt assembly according to claim 1 wherein the sleeve has a flared end section which opens onto the first end.

3. A rock bolt assembly according to claim 2 wherein the load bearing barrel is comprised of a solid body of a suitable metal material which has a domed or conical forward end and an opposed back end.

4. A rock bolt assembly according to claim 1 wherein the barrel has a plurality of grout conduits.

5. A rock bolt assembly according to claim 1 wherein the assembly includes the tensioning means between the proximal end of the bolt and the back end of the barrel.

6. A rock bolt assembly according to claim 5 wherein the tensioning means is a nut threaded onto the bolt.

7. A rock bolt assembly according to claim 1 which includes a grout delivery coupling member which has a body with a member first end and a member second end and a passage between the ends, a circular distributing channel in a wall of the passage and a grout inlet port in a side of the member which communicates an exterior of the member with the channel, wherein the passage is adapted to at least partially receive the barrel from the member first end and to engage with the barrel in a position in which the at least one grout conduit of the barrel sealingly docks with the channel.

8. A rock bolt assembly according to claim 7 wherein the coupling member engages with the barrel in a twist-lock manner.

9. A rock bolt assembly according to claim 8 wherein the barrel or the coupling member has a plurality of bayonet type projections which engage with complementary slots or recesses on the coupling member or the barrel respectively.

10. A method of anchoring a rock bolt within a rock hole, the rock bolt including an outer sleeve which extends between a first end and a second end opening into a funnel, an elongate bolt body which extends between a distal end and a proximal end, which locates within the sleeve and distal end section and a proximal end section extending beyond the first end and the second end of the sleeve as a distal end section and proximal end respectively, the distal end section of the bolt body partly carrying a mechanical anchor which is at least partially held within the sleeve in a closed position and the proximal end section of the bolt body being, at least partly, threaded, a faceplate located over the sleeve, a barrel on the threads of the proximal end section and a nut on the threads between the barrel and the proximal end, the method including the steps of pre-spacing the barrel from the funnel or the nut from the barrel, inserting the rock bolt into a predrilled rock hole, distal end leading, until the faceplate is sandwiched between a rock wall and an outer surface of the funnel and pushing the bolt body further into the rock hole to close the pre-spacing allowing the rock bolt to move relatively to the sleeve to drive the mechanical anchor from the first end of the sleeve and into an radially expansive open position in which the mechanical anchor resistively engages the walls of the rock hole, and engaging a coupling device to the barrel and pumping a grout material from a source through the coupling device, through at least one channel provided in a sidewall of the barrel, into a space between the sleeve and the bolt body and into an annular space between the sleeve and walls of the rock hole.

11. A method according to claim 10 wherein the rock bolt includes a tubular sleeve which locates on the bolt body, between the funnel and barrel or barrel and nut.

12. A method according to claim 11 wherein the tubular sleeve is made of a suitable plastics material which deforms or breaks when a force pushing the bolt further into the hole reaches a predetermined level.

* * * * *